United States Patent [19]

Habeger

[11] 4,455,465

[45] Jun. 19, 1984

[54] TREADLE ASSEMBLY WITH PLURAL REPLACEABLE TREADLE SWITCHES

[75] Inventor: Donald Habeger, New City, N.Y.

[73] Assignee: Automatic Toll Systems, Inc., Mount Vernon, N.Y.

[21] Appl. No.: 457,062

[22] Filed: Jan. 10, 1983

[51] Int. Cl.[3] ..... H01H 3/02

[52] U.S. Cl. ..... 200/86 R

[58] Field of Search ..... 200/85 R, 85 A, 86 R, 200/86 A

[56] References Cited

U.S. PATENT DOCUMENTS

| | | | |
|---|---|---|---|
| 2,165,227 | 7/1939 | Cooper | 200/86 R |
| 2,166,090 | 7/1939 | Cooper | 377/9 |
| 2,205,555 | 6/1940 | Cooper | 377/9 |
| 2,244,933 | 6/1941 | Armstrong | 200/86 R |
| 2,251,351 | 8/1941 | Cooper | 264/277 |
| 2,287,090 | 6/1942 | Cooper | 340/74 |
| 2,293,932 | 8/1942 | Cooper | 361/168.1 |
| 2,293,933 | 8/1942 | Cooper | 361/180 |
| 2,313,627 | 3/1943 | Cooper | 346/14 R |
| 2,761,928 | 9/1956 | Cooper et al. | 200/86 R |
| 2,813,164 | 11/1957 | Durbin | 200/86 R |

FOREIGN PATENT DOCUMENTS

| | | | |
|---|---|---|---|
| 1128116 | 1/1957 | France | 200/86 R |
| 419533 | 11/1934 | United Kingdom | 200/86 R |
| 467354 | 6/1937 | United Kingdom | 200/86 R |

*Primary Examiner*—J. R. Scott

*Attorney, Agent, or Firm*—Lee C. Robinson, Jr.

[57] ABSTRACT

A treadle switch assembly is formed of elongated treadle switch members disposed parallel to one another in a pan or tray embedded or otherwise disposed on a roadway surface. These individual treadle switch members are held in place in dovetail fashion by elongated retaining bars which can be bolted in place and by cooperating undercut members formed or longitudinally affixed on the tray. Favorably, the treadle switch members are of trapezoidal cross section, and the retaining bars are of a complementary trapezoidal cross section. This arrangement facilitates removal of a single treadle switch member when the same becomes worn or defective, merely by removing a single one of the retaining bars, thereby obviating the need to replace the entire assembly.

11 Claims, 5 Drawing Figures

TREADLE ASSEMBLY WITH PLURAL REPLACEABLE TREADLE SWITCHES

BACKGROUND OF THE INVENTION

This invention relates generally to treadles as may generally be used in roadways to sense vehicular traffic flow; this invention is more particularly directed to such treadles designed to be repaired or replaced without great expenditure of manpower or materiel resources.

Conventional treadle assemblies generally comprises a rubber treadle envelope containing a plurality of contact strips arranged to actuate a counter, thereby providing a record of the passage of vehicles over a predetermined section of the roadway. Typical such treadles are shown, e.g., in U.S. Pat. Nos. 2,761,928; 2,251,351; and 2,165,227.

Treadles have been generally utilized for counting of vehicular traffic and are conventionally disposed transversely on a roadway lane so that vehicles travelling in that lane must pass over the treadle. Quite often section of roadway occupied by the treadle may be at a toll plaza where a vehicle driver must slow down or stop and maneuver his vehicle to a toll booth, pay the required toll, and then accelerate to merge into the traffic on the toll facility, which may be a bridge, expressway, tunnel, or the like.

Treadles located at such installations have been subjected to excessive wear oweing to the traffic conditions associated therewith, and as a result of the vehicles' repeatedly rolling over the same portions of the treadles. As a result, the rubber envelope and contact strips contained therein must be replaced rather frequently.

It is the general practice to replace the entire treadle assembly as soon as the rubber envelope begins to show signs of significant wear, even though perhaps only a single pair of the contact strips may be affected by the wear. Also, the treadle assembly is rather cumbersome and massive, and replacement thereof requires the efforts of several workers for a period of up to a few hours.

OBJECTS OF THE INVENTION

Accordingly it is an object of this invention to provide a novel treadle assembly which facilitates repair and replacement only of the worn elements of the assembly without requiring remaining, unworn elements to be replaced.

It is another object of this invention to provide a treadle switch assembly in which installation, replacement, and/or repair can be easily carried out by a single worker.

It is a further object of this invention to provide a treadle switch assembly in which a plurality of individual treadle switches are securely but removable held in place on the assembly, and can be replaced by using only simple hand tools, such as a wrench.

SUMMARY OF THE INVENTION

In accordance with several favorable embodiments of this invention, a treadle switch assembly comprises a plurality of treadle switch members, each containing a pair of strip contacts arranged to be actuated, i.e., to close, under weight of a vehicle driven over the treadle switch member but to remain unactuated, or open when not subjected to the vehicle's weight. The treadle switch members are elongated individual switches, having a resilient envelope, preferably of a generally trapezoidal cross section. A tray or pan is provided to hold several of these members in a roadway lane, and the treadle switch members are disposed in the tray parallel to and spaced apart from one another. At least one retaining bar is disposed between successive ones of the elongated treadle switch members and is shaped to retain the same within the tray. Means are provided for holding the at least one retaining bar, and hence the elongated treadle switch members, within the tray.

In many favorable embodiments, in which the treadle switch members are of trapezoidal cross section, the members are disposed with a wider base side down, i.e., towards the tray, and with rising sides sloping inwardly towards a narrower top side. The retaining bars are then of a complementary trapezoidal cross sectional shape, i.e., with the narrower base side disposed towards the tray. Elongated mounting plates can be welded or otherwise affixed onto the tray to serve as spacers for the treadle switch members. The retaining bars are emplaced atop these mounting plates and removably fastened thereto, for example, by machine screws or bolts.

Undercut members, for example inwardly bent sides, can be provided at the lateral edges of the tray to mate with outer sides of the first and last ones of the treadle switch members.

When any one elongated treadle switch member becomes worn, or a fault is otherwise indicated therein, it is not required to replace the entire assembly. Instead, it is necessary only to unfasten one of the retaining bars and remove it. Then, the faulty or worn treadle switch member can be easily lifted out and replaced, after which the retaining bar can be put back and fastened down. Because the individual treadle switch members and retaining bars are relatively small and easily handled, the entire replacement operation can be carried out by a single worker in several minutes.

BRIEF DESCRIPTION OF THE DRAWINGS

The above and many other objects, features, and advantages of this invention will be more fully appreciated after consideration of the ensuing description, when read in connection with the accompanying drawing Figures, in which.

DESCRIPTION OF THE PREFERRED EMBODIMENTS

Figure 1:
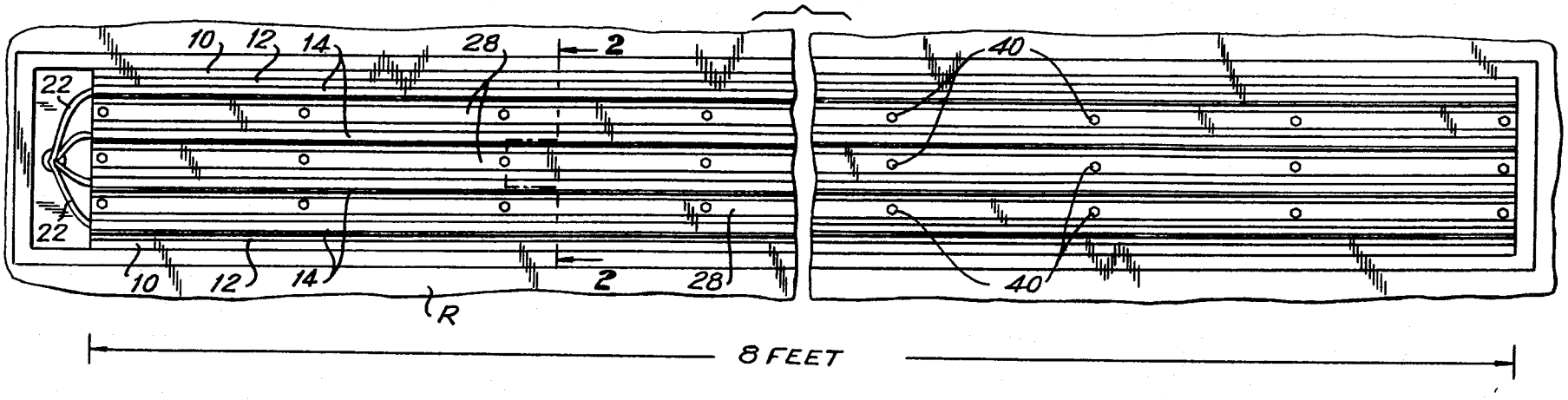
FIG. 1 is a top plan view of a four-treadle switch assembly according to one embodiment of this invention.
Figure 2:
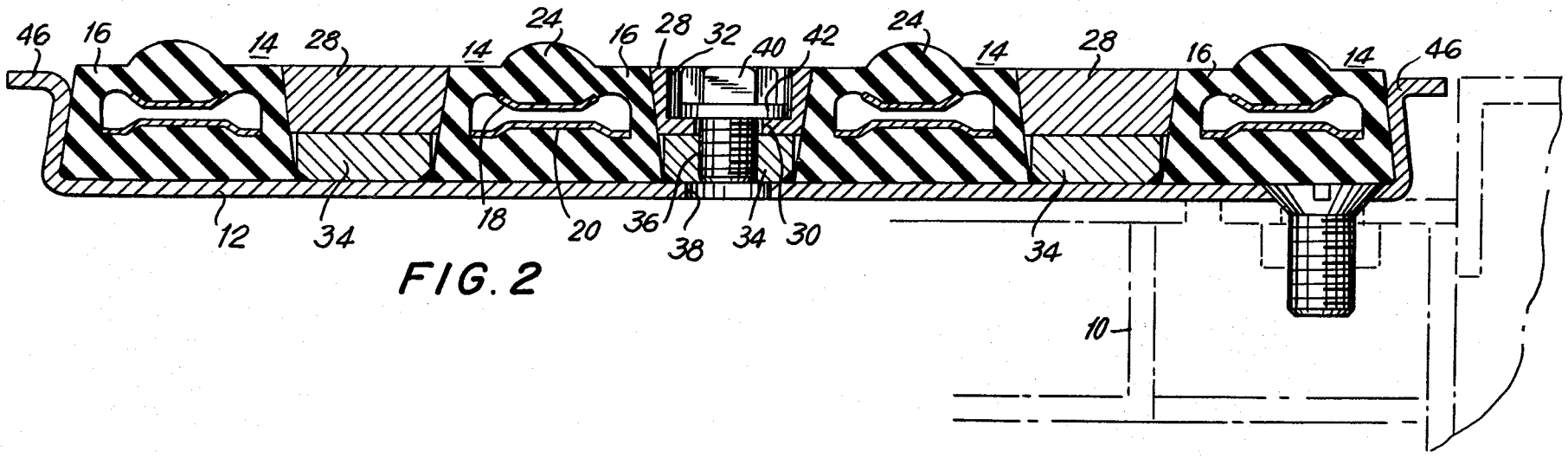
FIG 2 is a cross section taken at the line 2—2 of FIG. 1.

With reference to the drawings, and initially to FIGS. 1 and 2 thereof, a treadle switch assembly embodying the principles of this invention is disposed in a frame 10 embedded in a lane of roadway R. The assembly preferably has a length of approximately eight feet, so as to extend substantially across the entire lane of roadway R.

The treadle switch assembly includes a flat tray or pan 12 fastened to the frame 10, for example, by bolts or machine screws. In this embodiment, first, second, third, and fourth elongated treadle switch members 14 are disposed on the tray 12 parallel to each other and spaced apart from one another.

As is conventional, the treadle switch members 14 are formed of an envelope 16 of rubber or other resilient material, having an upper contact strip 18 and a lower contact strip 20 disposed facing one another in a longitudinal cavity of a generally dogbone-shaped cross section. These contacts 18, 20 have leads 22 extending from one end of each treadle switch member 14, as shown in FIG. 1. Preferably, these leads 22 are of about 50 feet in length, so that they can be connected to an automatic counter (not shown) located at some distance from the roadway R. Here, all the leads 22 feed into a common conduit C extending to the automatic counter.

Unlike former and conventional multiple treadle switch arrangements, in this embodiment the treadle switch members 14 are formed as individual elongated units. Here, the envelopes 16 are of substantially trapezoidal cross section, with a wider base thereof directed towards the tray 12, and with sides sloping generally inwardly as they rise to the top of the envelope 16. A protuberance 24 is optionally provided atop each of the resilient envelopes 16 to facilitate closing of the contacts 18, 20 when a vehicle rolls over the respective treadle switch member 14.

The tray 12 has longitudinal edges 26 thereof bent slightly inwards to mate with corresponding sides of the first and fourth (i.e., outside) treadle switch members 14. Retaining bars 28, also of trapezoidal cross section, are disposed between successive ones of the treadle switch members 14. Each of these retaining bars 28 has a smaller base directed downwards, i.e., towards the base of the tray 12, and has sides rising slopingly outwards to engage corresponding sides of the associated treadle switch members 14.

A succession of bores 30 or bolt holes is provided in each of the retaining bars 28, with a countersunk recess 32 being formed on the top side of each such bore 30.

Elongated mounting plates 34 of generally rectangular cross section extend the length of the tray 12 between the positions of successive ones of the treadle switch members 14. These mounting plates 34 are welded or otherwise affixed to the tray 12. Threaded bores 36 are provided in the plates 34 at positions corresponding to the positions of the bores 30 in the retaining bars 28, and further corresponding openings 38 are provided through the base of the tray 12.

Hex-head machine screws 40, which can be accompanied favorably with lock washers 42, serve to fasten each of the retaining bars 28 in place atop its associated mounting plate 34.

It should be appreciated that the height, or vertical thickness of each of the treadle switch members 14 (not including the protuberance 24) is substantially the same height as the retaining bar 28 when placed atop its associated mounting plate 34. Also, in this embodiment, the head of the machine screw 40 seated within its associated recess 32 is substantially flush with the top of the associated retaining bar 28.

Figure 3:
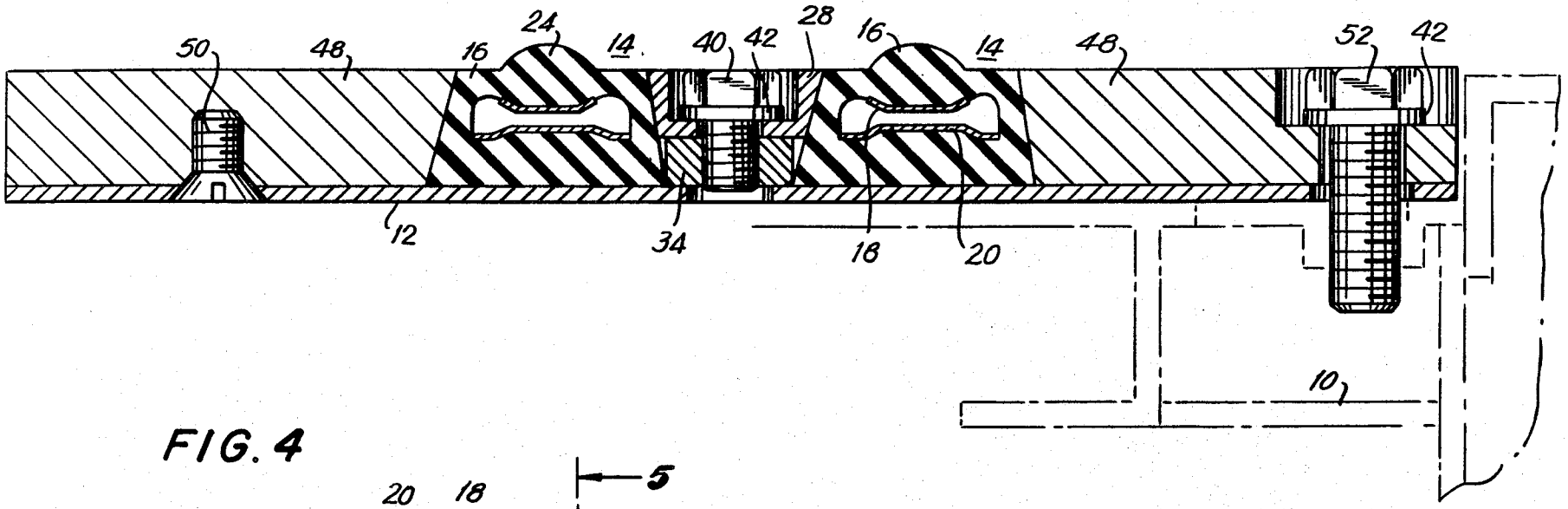
FIG. 3 is a cross sectional view of a two-treadle switch assembly according to another embodiment of this invention.

With reference to FIG. 3, in which parts corresponding to elements shown in FIGS. 1 and 2 are identified with the same reference numbers, and for which a detailed description can be omitted, another favorable embodiment of this invention employs a pair of treadle switch members 14, with a single retaining bar 28 disposed therebetween on a mounting plate 34. Here, a pair of undercut plates 48 are fastened onto the tray 12, either by means of a machine screw 50 fastening an underside of the plate 48 directly to the base of the tray 12, or by means of a machine screw 52 fastened through mounting apertures in the plate 48 and the tray 12 directly to the frame 10. In this embodiment, the undercut plates 48 have sloping sides which engage corresponding sloping sides of the resilient envelopes 16 of the treadle switch members 14. Also, these undercut plates 48 are favorably of the same height, or vertical thickness as the treadle switch members 14.

Figure 5:
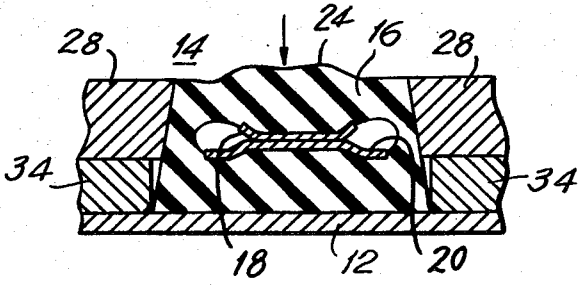
FIG. 5 is a cross section of the treadle switch member of FIG. 4 taken at the line 5—5 thereof.

Although the operating principles of treadle switches such as the resilient treadle switch members 14 are well understood, for the sake of completeness the specific structure and operation of these members will be explained with reference to FIGS. 4 and 5.

Figure 4:
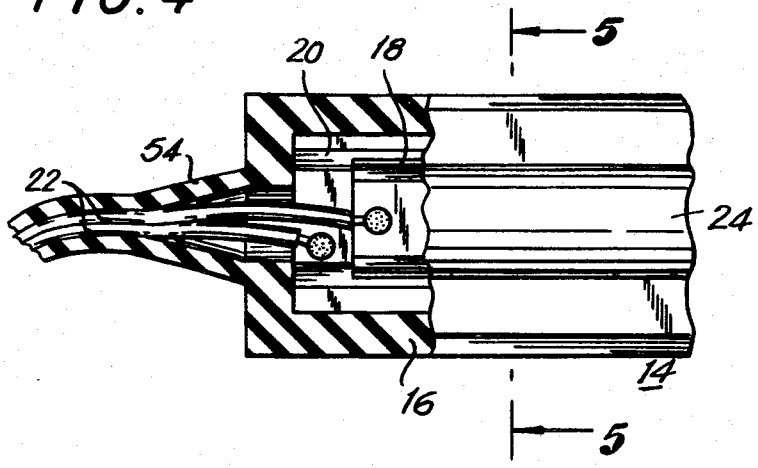
FIG. 4 is a plan view, partially cut away, illustrating one replaceable treadle switch member used in connection with embodiments of this invention.

As shown in FIG. 4, and also in FIGS. 2 and 3, each individual treadle switch member 14 has facing contact strips 18 and 20 disposed within the resilient envelope 16. The leads 22 can be soldered to these contact strips 18 and 20 at one end thereof, and favorably extend out of one end of the envelopes 16. A sleeve 54, molded to the envelope 16, extends over the lead 22 from the envelope 16. This sleeve 54 is designed to exclude dust, water, and other contaminants and corrosives. The resilient envelope 16 normally holds these contact strips 18 and 20 apart from one another in an open-circuit configuration, as shown in FIGS. 2 and 3. However, if the wheel of an automobile, truck, or other vehicle passes over the proturberance 24, the envelope 16 crushes, as shown in FIG. 5, so that the contact strips 18 and 20 are brought into electrical engagement with one another. Then, after the treadle switch member 14 is relieved of the vehicle weight, the resilient envelope restores itself to its normal shape as in FIGS. 2 and 3, and the contact strips 18, 20 separate from each other.

As is clear from the foregoing description and the accompanying drawings, the retaining bars 28, in connection with either the bent-in edges 26 of the tray or the undercut plates 48, serve to define spaces for the treadle switch members 14, so that the latter are held in dovetail fashion onto the tray 12.

With treadle switch assemblies according to this invention, the treadle switch members 14 can be easily replaced when they become worn or defective. For example, in either the embodiment of FIGS. 1 and 2 or that of FIG. 3, any individual treadle switch member 14 can be removed by first removing the machine screws 40 from the retaining bar 28 along one side of the treadle switch member 14, and then by lifting out that retaining bar 28. With the latter removed, the treadle switch member 14 can be pulled up and removed. Then, a new treadle switch member 14 can be inserted in its place, the retaining bar 28 can be put back, and the machine screws 40 fastened in place. Thereafter, the leads 22 of the new treadle switch member 14 can be connected to the associated electrical counting equipment to complete the repair or replacement operation.

With the arrangement of this invention, only a single retaining bar 28 and a single treadle switch member 14 need to be handled when only a single treadle switch member 14 is worn or faulty. Thus, the job of repairing the assembly can be conducted quickly by a single workman. As is apparent, it is considerably more cost effective to replace only one treadle switch member 14 when the same is defective, rather than to replace an entire assembly, as was required with conventional treadle switch assemblies.

The treadle switch members 14 need not have the exact shape shown, so long as they can be held in place by appropriately shaped retaining bars 28. Moreover, rather than machine screws 40, any convenient fastening means can be used to hold down the restraining bars 28. For example, rather than the machine screws 40, threaded studs can be mounted on the plates 34, and the retaining bars 28 can be fastened down using hex nuts.

Furthermore, rather than mounting the restraining bars 28 atop the elongated plates 34, they can be mounted on other appropriate members, or directly to the base of the tray 12.

While preferred embodiments of this invention have been described in detail hereinabove, it should be recognized that many modification and variations thereof will present themselves to those of skill in the art without departure from the scope and spirit of this invention, as defined in appended claims.

What is claimed is:

1. A switch treadle assembly comprising a tray adapted to be disposed in a roadway; a plurality of elongated, unitary treadle switches of substantially straight-sided cross section each containing a pair of contacts to close under weight of a vehicle passing over the associated treadle switch and to open when not subject to said weight, said elongated treadle switches being disposed spaced apart and parallel to each other within said tray; at least one retaining bar each disposed between successive ones of said elongated treadle switches and shaped to retain the same within said tray; and fastening means for releasably holding said at least one retaining bar, and hence said elongated treadle switches, within said tray.

2. A multiple switch treadle assembly comprising a tray adapted to be embedded in a roadway; a plurality of elongated, unitary treadle switches of substantially straight-sided cross section each containing contacts to close under weight of a vehicle passing over the associated treadle switch and to open when not subjected to said weight, said elongated treadle switches being disposed spaced apart and parallel to each other within said tray; a plurality of retaining bars each disposed between successive ones of said elongated treadle switches and shaped to retain the same within said tray; and fastening means for releasably holding said retaining bars, and hence said elongated treadle switches, within said tray.

3. A plural switch treadle assembly comprising a tray adapted to be positioned in a roadway; a plurality of elongated treadle switches each containing contacts to close under the weight of a vehicle passing over the associated treadle switch and to open when not subjected to said weight, said elongated treadle switches being disposed spaced apart and parallel to each other within said tray, and each said elongated treadle switch being formed of resilient material and of generally trapezoidal cross section with a large base against said tray, and with sides sloping generally inward to a top; undercut means on said tray to engage the sloping side of a first and a last of the elongated treadle switches; at least one retaining bar of substantially trapezoidal cross section with a small base toward said tray and with sides sloping generally outward to a top side; and fastening means for releasably holding said at least one retaining bar on said tray such that said treadle switches are held in dovetail fashion by said at least one retaining bar and said undercut means.

4. A multiple switch treadle assembly comprising a tray adapted to be positioned in a roadway; a plurality of elongated treadle switches adapted to be actuated by the weight of a vehicle passing thereover and disposed spaced apart and parallel to one another within said tray, and each being formed as a resilient member of generally trapezoidal cross section with a large base disposed toward said tray and with sides sloping generally inward to a top; undercut means on said tray to engage one sloping side of each of a first and a last of the elongated treadle switches; at least one elongated plate disposed between successive ones of said treadle switches and welded onto said tray, each said at least one plate having a succession of threaded bores therein; at least one retaining bar of substantially trapezoidal cross section with a small base to be disposed against the associated elongated plate and with sides sloping generally outward to a top side thereof, each said retaining bar having a succession of bolt holes corresponding to said threaded bores in the at least one elongated plate; and a plurality of bolts disposed in said bolt holes and having heads and shanks mating with said threaded bores holding said at least one retaining bar onto the associated at least one elongated plate such that said elongated treadle switches are maintained in dovetail fashion by cooperation with the latter of said at least one retaining bar and said undercut means.

5. A multiple switch treadle assembly according to claim 4, wherein said bolt holes are countersunk at the top side of said at least one retaining bar such that said the heads of bolts when in place are flush with said top side.

6. A multiple switch treadle assembly comprising an elongated tray having a base, a first side rising at one edge of the base and sloping inward and a second side rising at an opposite edge of the base and sloping inward; first, second, and third elongated plates spaced in succession from one another between the first and second sides and affixed on the base of the tray parallel to each other defining, with the first and second sides, first, second, third, and fourth treadle spaces, the elongated plates having threaded bores thereon; first, second, third, and fourth elongated treadle switch members adapted to fit removably in said first, second, third, and fourth spaces, respectively, said treadle switch members each having a generally trapezoidal cross section with a base and sides sloping inward to a top thereof; first, second, and third retaining bars each of generally trapezoidal cross section and having a narrow base to be disposed against the associated one of the elongated plates, and sides sloping outward to a top thereof, with bolt holes provided corresponding to the threaded bores in the associated elongated plates; and bolt means having threaded portions engaging said threaded bores and head means engaging said retaining bars at said bolt holes such that said elongated treadle switch members are retained on said tray in dovetail fashion with the cooperating first and second sides of the tray and said retaining bars.

7. A multiple switch treadle assembly according to claim 6; wherein said treadle switch members are formed of resilient material and adapted to be actuated by weight of a vehicle passing thereover.

8. A multiple switch treadle assembly according to claim 7; wherein said resilient treadle switch members have a predetermined height, and said associated plates and retaining bars together have substantially the same predetermined height.

9. A double switch treadle assembly comprising a tray having a horizontal base; an elongated plate affixed onto the base of said tray, and having a succession of threaded bores thereon; first and second elongated treadle switch members removably disposed on said tray along said elongated plate on opposite sides thereof said treadle switch members each having a generally trapezoidal cross section with a base disposed towards the base of said tray and first and second side sloping inward toward a top thereof with the first sides thereof being disposed alongside said elongated plate; first and second undercut members affixed onto said tray and disposed against the second sides of said first and second treadle switch members respectively; a retaining bar of generally trapezoidal cross section and having a narrow base to be disposed against the elongated plate and having a corresponding succession of bolt holes therein; and bolt means having threaded portions engaging said threaded bores and head means engaging said retaining bar at said bolt holes such that said elongated treadle switch members are retained on said tray in dovetail fashion by cooperation of said retaining bar and said first and second undercut members.

10. A double switch treadle assembly according to claim 9, wherein said treadle switch members, said undercut members, and said elongated plate and retaining bar when bolted together, are of substantially the same predetermined height.

11. An assembly according to claim 3, wherein said undercut means include a first side of the tray rising obliquely and inwardly at one edge of the tray and a second side of the tray rising obliquely and inwardly at an opposite edge of the tray, the inwardly rising first and second sides respectively engaging sloping sides of said first and last switches, such that said first and last switches are each held in dovetail fashion by the associated inwardly rising tray side and a respective said retaining bar.

* * * * *